US008104115B2

(12) United States Patent
Gramkow et al.

(10) Patent No.: US 8,104,115 B2
(45) Date of Patent: Jan. 31, 2012

(54) HANDLING SYSTEM FOR LIFTING OR MOVING A PERSON, A WEIGHTING SYSTEM AND METHOD OF LIFTING AND MOVING A PERSON

(75) Inventors: Asger Gramkow, Augustenborg (DK); Asger Moos, Krusa (DK)

(73) Assignee: HeCare Systems ApS (DK)

( * ) Notice: Subject to any disclaimer, the term of this patent is extended or adjusted under 35 U.S.C. 154(b) by 716 days.

(21) Appl. No.: 11/914,011

(22) PCT Filed: May 9, 2006

(86) PCT No.: PCT/DK2006/000248

§ 371 (c)(1),
(2), (4) Date: Nov. 9, 2007

(87) PCT Pub. No.: WO2006/119769

PCT Pub. Date: Nov. 16, 2006

(65) Prior Publication Data

US 2008/0189852 A1 Aug. 14, 2008

(30) Foreign Application Priority Data

May 9, 2005 (DK) ..... 2005 00668

(51) Int. Cl.
*A61G 7/10* (2006.01)

(52) U.S. Cl. ..... 5/83.1; 5/86.1; 5/87.1

(58) Field of Classification Search ..... 5/81.1 R, 5/83.1, 85.1–87.1, 89.1; 177/144
See application file for complete search history.

(56) References Cited

U.S. PATENT DOCUMENTS

| | | | | |
|---|---|---|---|---|
| 3,750,199 | A | 8/1973 | Spivey | |
| 3,940,808 | A | 3/1976 | Petrini et al. | |
| 4,644,595 | A | 2/1987 | Daniel et al. | |
| 4,875,555 | A | 10/1989 | Johansson et al. | |
| 5,651,149 | A | 7/1997 | Garman | |
| 5,697,110 | A * | 12/1997 | Campbell | 5/81.1 R |
| 5,758,371 | A | 6/1998 | VanDyke et al. | |
| 5,892,180 | A * | 4/1999 | Carey | 177/144 |
| 6,047,418 | A | 4/2000 | Seide et al. | |
| 6,329,612 | B1 * | 12/2001 | von Schroeter | 177/144 |
| 7,634,824 | B2 * | 12/2009 | Gramkow et al. | 5/81.1 R |
| 2008/0189852 | A1 * | 8/2008 | Gramkow et al. | 5/85.1 |

FOREIGN PATENT DOCUMENTS

| | | |
|---|---|---|
| EP | 0 236 284 | 9/1987 |
| GB | 2 260 751 | 4/1993 |
| GB | 2338226 | 12/1999 |

OTHER PUBLICATIONS

International Search Report; PCT/DK2006/000248; Oct. 12, 2006.

* cited by examiner

*Primary Examiner* — Michael Trettel
(74) *Attorney, Agent, or Firm* — Cantor Colburn LLP

(57) ABSTRACT

The invention relates to a handling system for lifting or moving a person from a first position to another, such as from a bed to a chair. The system includes a bottom part being vertically fixed, a lifting arm being guided by the bottom part allowing the lifting arm to at least be vertically adjustable, a support part for fixating and supporting the person during the lifting and moving, and a support connection for the support part. The support connection is connected to drive means, for winding and unwinding the support connection, via the lifting arm, and the drive means being part of the bottom part.
The invention also relates to a weighting system and a method for lifting or moving a person.

24 Claims, 11 Drawing Sheets

HANDLING SYSTEM FOR LIFTING OR MOVING A PERSON, A WEIGHTING SYSTEM AND METHOD OF LIFTING AND MOVING A PERSON

TECHNICAL FIELD OF THE INVENTION

The invention relates to a handling system for lifting or moving a person, a weighting system, and a method for lifting or moving a person.

BRIEF DISCUSSION OF RELATED ART

Handling systems for lifting and moving persons and particularly disabled persons are well known in the art.

A typical handling system comprises a base part provided with wheels supporting a tower with a horizontal arm at the top. The free end of the horizontal arm is connected to a device such as a harness or a chair supporting and fixating the person during the lifting and moving from e.g. a bed to a chair.

The handling systems are also provided with a guided connection between the tower and the horizontal arm, making it possible to manually adjust the height of the horizontal arm with an electric linear actuator and thus handle the person.

A disadvantage of the known handling systems is the complexity and cost in establishing a long linear movement which is precise and continuous. Further, it is a disadvantage that the person in the supporting harness or a chair is separated from the linear actuator system by the lifting arm.

Another type of handling system involves a number of rails mounted in the ceiling. A harness with a winch is connected to the rails and thus allowing a person to be handled and moved along the rails.

A few disadvantages of the rail systems are the complexity and costs of the systems as well as the restrictions in movement by the usually limited number of rail tracks.

BRIEF SUMMARY OF THE INVENTION

The invention provides a handling system without the above mentioned disadvantages. Especially, the invention creates a handling system which is simple, reliable and inexpensive to manufacture as well as to establish a close connection between the lifting part of the handling system and the person being handled.

The invention relates to a handling system for lifting or moving a person from a first position to another, e.g. from a bed to a chair. The system especially relates to a support connection being connected to drive means, for winding and unwinding said support connection, via the lifting arm, said drive means include an electrical motor, and said drive means is part of said bottom part.

This is advantageous in that it provides for a simple and cost efficient design of a handling system, and it provides for the handling system with at large lifting height combined with the possibility of adjusting the height of the lifting arm i.e. the total system height during use. Further, it especially allows a direct support connection between the lifting part including the drive means of the handling system and the person being handled in a support part such as a handling chair to be established.

By the term "via the lifting arm" is to be understood through or in connection with the lifting arm. This means that the support connection can pass through on the inside of the lifting arm, it can run on the outside of the arm or any combination of the two.

In an aspect of the invention, said lifting arm comprises, a vertical part including a guided end inside the bottom part and a horizontal part including a free lifting end. It is advantageous to provide the lifting arm with a horizontal part being connected to a guided vertical part, in that it makes it possible to keep the support part or the person fixed in the support part clear of the bottom part and the lifting arm.

In an aspect of the invention, said lifting arm comprises a front support connection guide placed at said free lifting end, a corner support connection guide placed at the corner of the lifting arm, a bottom support connection guide being placed at the guided end and said bottom part comprise a top support connection guide at the top of the section of the bottom part guiding said lift arm. It is advantageous to place support connection guides in these places, in that it makes it possible to guide the support connection so that it stays clear of the support part or the person fixed in the support part during use of the lift.

Further, it is advantageous to place support connection guides in these places, in that it makes it possible to guide the support connection all the way to the top of the vertical guiding part, and thereby enabling the lifting arm to be lifted all the way to the end of the vertical guiding part.

In an aspect of the invention, said support connection guides are idling pulleys. It is advantageous to use idling pulleys for guiding the support connection, in that it provides for a simple, cost efficient and substantially friction free guide.

By the term "support connection guide" is to be understood any kind of plate, rod, pipe, pulley, wheel, roller, chain wheel, timing wheel or other contraptions suitable for guiding a support connection.

In an aspect of the invention, said support connection is a continuous belt guiding said support connection. It is advantageous to use a continuous belt as support connection, in that a belt is easy to guide and it is easy to wind and unwind a belt safely without it getting tangled. Further, making the belt continuous is advantageous in that it provides for a simple and cost efficient design of the handling system.

In an aspect of the invention, said drive means for winding and unwinding said support connection, is driven by an electrical motor with gearing means. An electrical motor is relative quiet during use, it is easy to implement and it is relatively inexpensive.

In an aspect of the invention, said bottom part comprises at least one locking system with at least one lock engaging means and locking holes e.g. for securing said lifting arm to said bottom part or to said support part at a fixed height. This is advantageous in that it makes it possible to use the handling system for lifting or lowering persons with the lifting arm at any possible height as well as establishing a fixed and steady connection between the support part and the lifting arm e.g. during movement of a person in the handling system.

The invention further relates to a weighting system for use in a handling system wherein said weighting system includes weighting means measuring the tension of said support connection carrying the weight of the person in said support part.

The direct support connection between the lifting part including the drive means of the handling system and the person being handled in a support part such as a handling chair allows a direct and precise weight measurement to be performed.

It is advantageous to provide the handling system with a weighting system, in that besides from the obvious advantage of keeping close track of the weak, sick or disabled person's weight, it also provides the possibility of providing the handling system with an overload protection.

Especially the through going nature of the support connection in the handling system makes it easy and simple to perform the direct weighting of the person being handled. Further, the weighting and handling process may be performed as one operation and consequently the nuisance of the handled person is minimized.

In an aspect of the invention, said weighting means include at least one strain gauge being part of the front and/or corner support connection guides and an external computer communication socket. Since the handling system is provided with a support connection connecting the support part with the drive means via the lifting arm, it is advantageous to weight the load on the support part by measuring the tension of the support connection e.g. by measuring the deflection of a strain gauge mounted idling pulley, in that it is a simple and inexpensive way of measuring weight. With an external computer communication socket it is possible to communicate the weight data to an external computer and thus perform different statistical output on the person being handled as well as store the data centrally e.g. in the persons hospital data file. Further, the communication socket may be used to communicate the weight data to an electronic display on or in proximity of the handling system.

BRIEF DESCRIPTION OF THE DRAWINGS

The invention will be described in the following with reference to the figures in which.

DETAILED DESCRIPTION OF THE INVENTION

Figure 1:
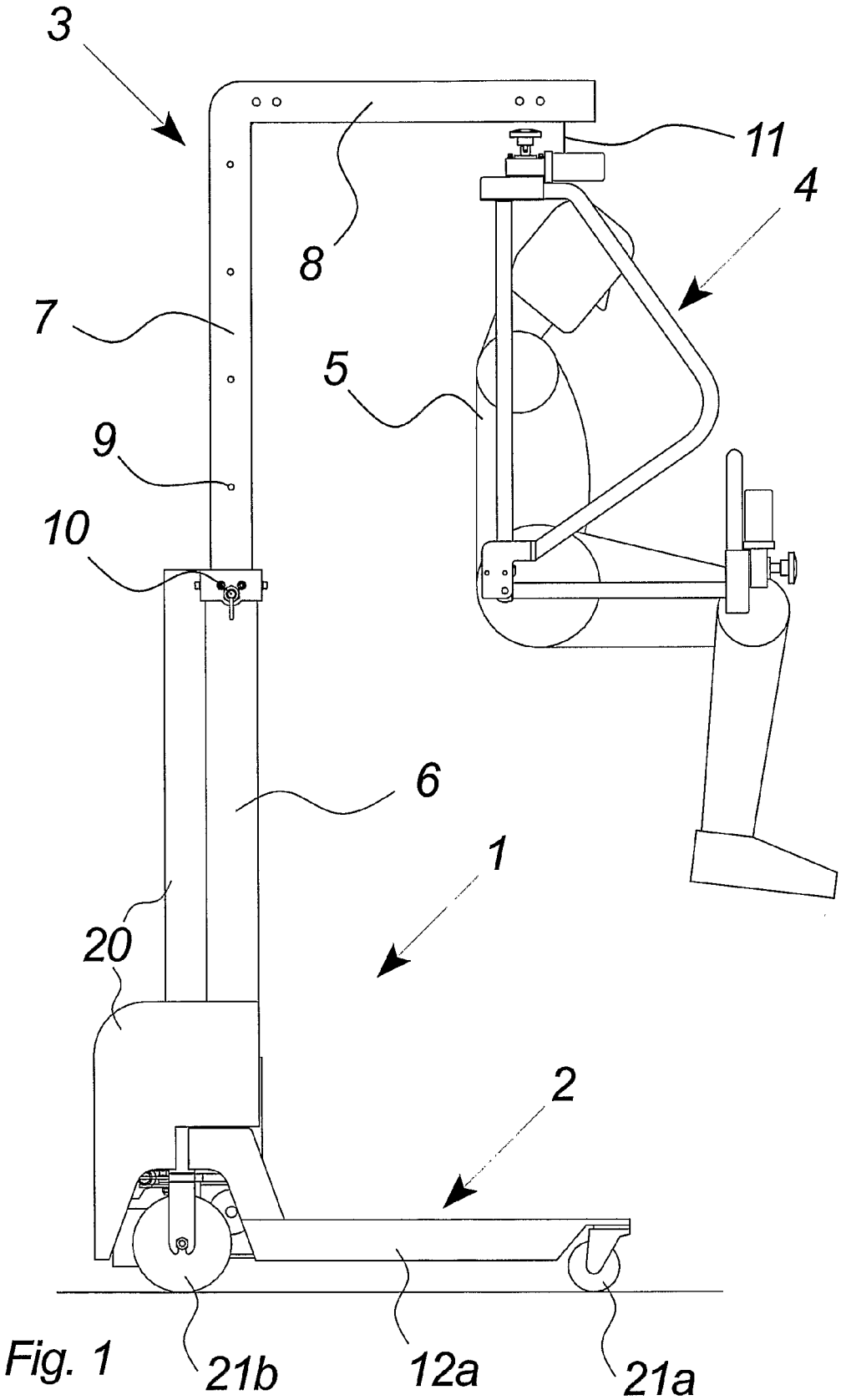
FIG. 1 illustrates a handling system with a person hanging in a support part such as a handling chair.

FIG. 1 illustrates a handling system 1 with a person 5 hanging in a support part 4 such as a handling chair. A support connection 11 connects the support part 4 with the free end of a lifting arm 3 in the handling system 1.

The handling system 1 comprises bottom part 2 being vertically fixed and with a left and right base frame part 12*a* pivotally connected to the rest of the bottom part 2. The vertical guiding part 6 of the bottom part 2 is a hollow square tube which upwards ends in a reinforcing opening for the lifting arm 3. The guiding end of the lifting arm 3 is a hollow square tube with outer dimension allowing it to freely slide inside the vertical guiding part 6. A cover 20 establishes most of the surface for the bottom part 2.

In this embodiment of the invention the handling system 1 comprise a first locking system 10, which fixates the vertical position of the lifting arm 3 in relation to the bottom part 2. The illustrated system works by manually placing at least one lock engaging means 10 (e.g. in form of a metal pin) placed on or at least guided by a lock guide placed on the bottom part 2 in one or more locking holes 9 in the lifting arm 3. In another embodiment the process of placing the lock engaging means 10 in the locking holes 9 could be done automatically e.g. by means of an electromagnetic solenoid lock (not shown), which e.g. by means of a spring pushes a lock pin out into a locking hole 9. When receiving a given electrical signal the electromagnetic solenoid lock retracts the pin from the hole again. This would also provide the locking system 10 with at safety function, in that if a power failure occurred, then the locking pin would stay out or be pushed out by the spring.

The electromagnetic solenoid lock could be placed on the bottom part 2 extending its pin into locking holes 9 in the lifting arm 3 or it could be placed on the lifting arm 3 extending its lock engaging means 10 into locking holes 9 in the bottom part 2.

In another embodiment the first locking system 10 could also be a friction lock working by friction. In a mechanical system such as a handling system 1 a friction lock would in general work by establishing a friction between the lifting arm 3 and the bottom part 2, which is high enough to secure the lifting arm (3) in a fixed vertical position in relation to the bottom part, as long as a defined max. load is not exceeded (e.g. if a person weighing more than 250 kilograms was placed on the support part 4).

An example of such a friction lock could be one or more bolts are placed in boltholes in the upper end of the bottom part 2. When these bolts are tightened, the end of the threaded part of the bolts press either directly against the outer surface of the lifting arm 3, or indirectly via a disk of friction material, which would distribute the load over a larger area hereby reducing the risk of the brake 10 deforming the lifting arm and increasing the capacity of the brake 10 by increasing the friction. Further embodiments of friction locks working by friction are also described later e.g. under FIG. 11.

The bottom part 2, lifting arm 3, support connection 11 and support part 4 together define the handling system 1 as a lifting device for the person 5. The handling system 1 may especially handle a disabled person such as a bedridden person that needs lifting and movement to a second position e.g. a chair and vice versa. Further description of handling systems may be found in International Pat. No. PCT/DK2004/000070 "Method of . . . " in the name of Asger Gramkow, the disclosure of which is herein incorporated by reference.

Figure 2A:
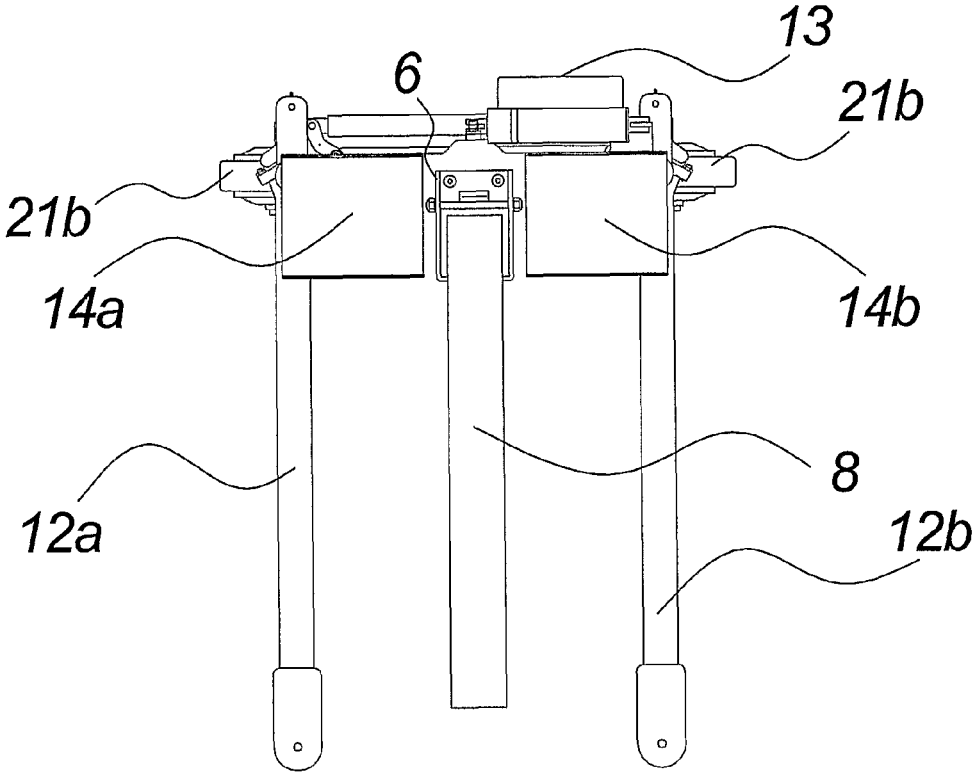
FIGS. 2*a* and 2*b* illustrate the handling system seen from above and with the support part.
Figure 2B:
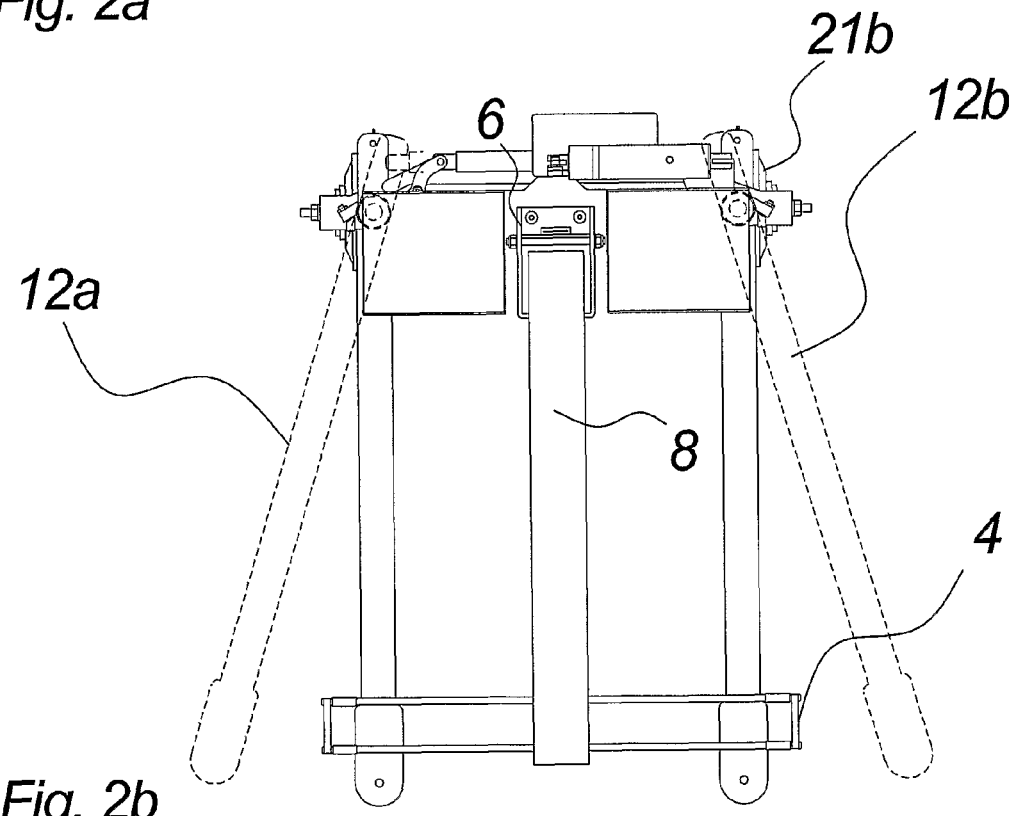

FIGS. 2*a* and 2*b* illustrate the handling system seen from above and with the support part.

The figures (together with FIG. 3) illustrate that, besides being foundation for the lifting arm 3, the bottom part 2 also comprises a number of wheels 21*a*, 21*b* allowing the handling system to be moved over a surface e.g. a floor. The front wheels 21*a* are each positioned below one front end of base frame parts 12*a*, 12*b*. The front wheels 21*a* are connected to the base frame parts with a single vertical axle allowing the wheels to move freely horizontally in a given direction depending on the direction of the force they experience.

At the opposite end of the base frame parts 12*a*, 12*b* are positioned two drive wheels 21*b*. Each wheel and the base part may turn around a vertical axle in a given direction controlled by a wheel controller connected to each of the wheels 21*b* through connection arms.

The controlled drive wheels 21*b* are each connected to an electric motor. The motors transfer force to the wheels and thus forcing them to turn forward or backwards at an individually controllable speed. Hereby, it is possible to move the handling system in a desired direction e.g. sideways (as illustrated in FIG. 2*a* with the drive wheels positioned in a 90 degree angle) or forward/reverse (as illustrated in FIG. 2*b*). The electric energy to the motors is supplied by two electric accumulators 14*a*, 14*b* positioned on opposite side of the vertical guiding part 6.

The accumulators also supply energy to the rest of the handling system 1 including the drive means for controlling the lifting arm 3.

In order to be able to change the width between the base frame parts 12*a*, 12*b* at their front ends, comprising the free directional wheels, the base parts are connected to a controller of the width as illustrated in FIG. 2*b*.

Figure 3:
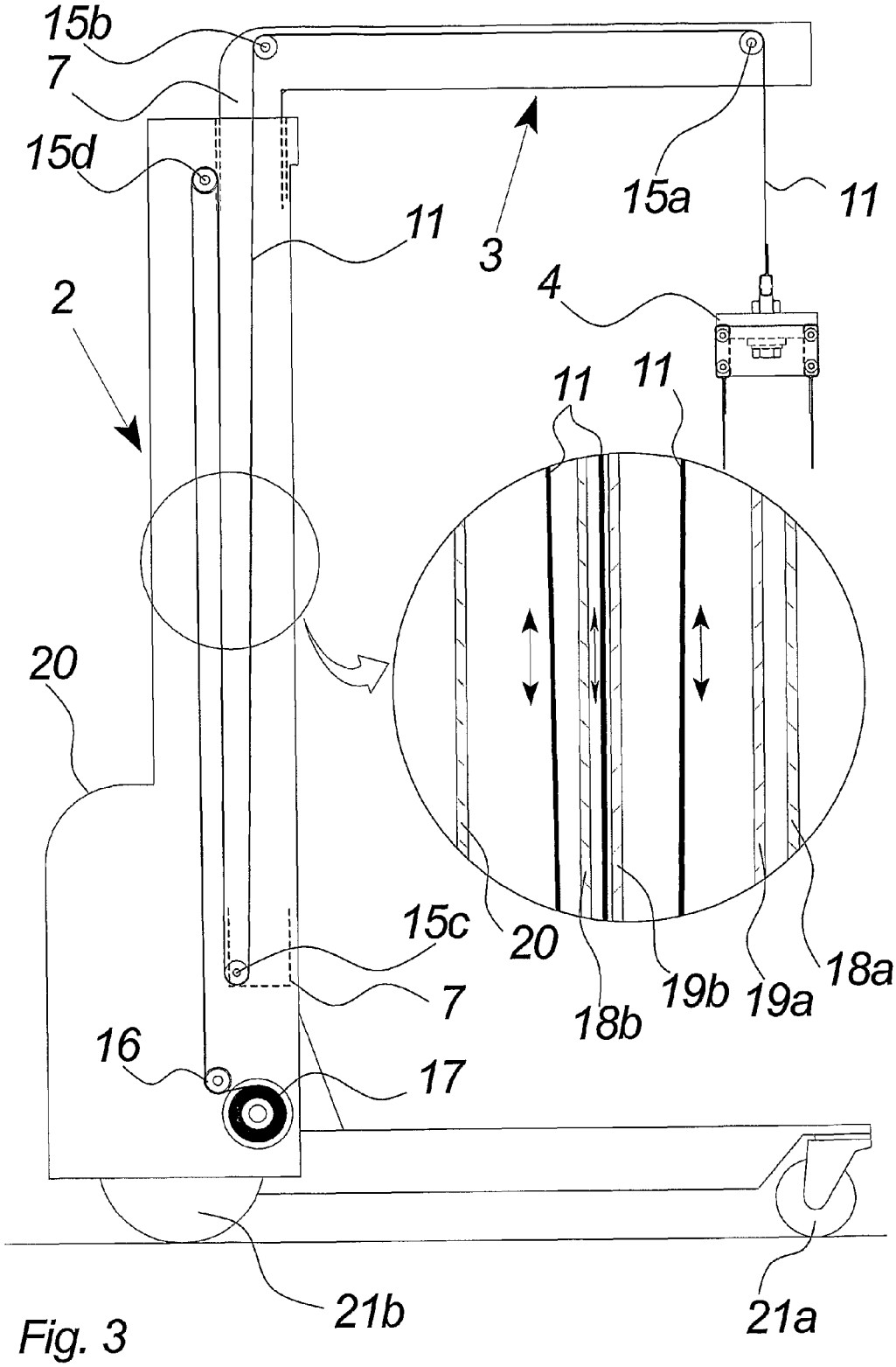
FIG. 3 illustrates a schematically view of the support connection path inside the handling system according to a preferred embodiment of the invention.

FIG. 3 illustrates a schematically view of the support connection path inside the handling system according to a preferred embodiment of the invention.

The figure especially illustrates a number of support connection guides 15*a* to 15*d* defining the path of the support connection 11. A front support connection guide 15*a* is positioned inside the free end of the lifting arm 3, the corner support connection guide 15*b* is positioned in the perpendicular bend of the lifting arm 3 and the bottom support connection guide 15*c* is positioned in the guided end of the lifting arm 3. The top support connection guide 15*d* is positioned at the top of the section of the bottom part guiding the lift arm 3. The guides are preferably idling pulleys guiding the support connection 11 through the handling system 1.

The path of the support connection 11 starts at connection point to the support part 4 and continues into the lifting arm 3 through a lower opening at the front support connection guide 15*a*. The support connection 11 is guided by the front support connection guide 15*a* in a horizontal direction toward the corner support connection guide 15*b* inside the horizontal part 8 of the lifting arm 3. The corner support connection guide 15*b* directs the support connection 11 in a vertical direction toward the bottom support connection guide 15*c* inside the vertical part 7 of the lifting arm 3.

The vertical part 7 of the lifting arm 3 is established by walls including a front and rear wall 19*a*, 19*b* as illustrated in the magnified area. The walls are surrounded by inner walls of the vertical guiding part 6 including a front and rear wall 18*a*, 18*b* (wherein the front wall 18*a* also defines the outer walls of the guiding part 6 together with the cover 20). The rear walls 18*b*, 19*b* are separated by a minor space allowing the support connection 11 just to be moved inside the space. Further, the support connection 11 is moved inside the vertical part 7 of the lifting arm 3 (i.e. between the walls 19*a*, 19*b*) and in the bottom part 2 (i.e. between the walls 18*b*, 20).

The support connection 11 is moved through an opening in the side wall or bottom of the vertical part 7 and enters the above mentioned minor space before reaching the top support connection guide 15*d* through an opening in the outer wall 18*b*. The top support connection guide 15*d* is part of and fixed to the bottom part 2. The top support connection guide 15*d* directs the support connection 11 toward drive means fixed to the bottom part 2. The drive means may include a guide 16, a winch 17 and an electric motor 13 (illustrated in FIGS. 2*a* and 2*b*). The electric motor includes gearing means such as a worm gear system. The drive means may be used to wind and unwind the support connection 11 from the bottom part 2 via the guides 15*a* to 15*d* and the lifting arm 2.

Figure 4:
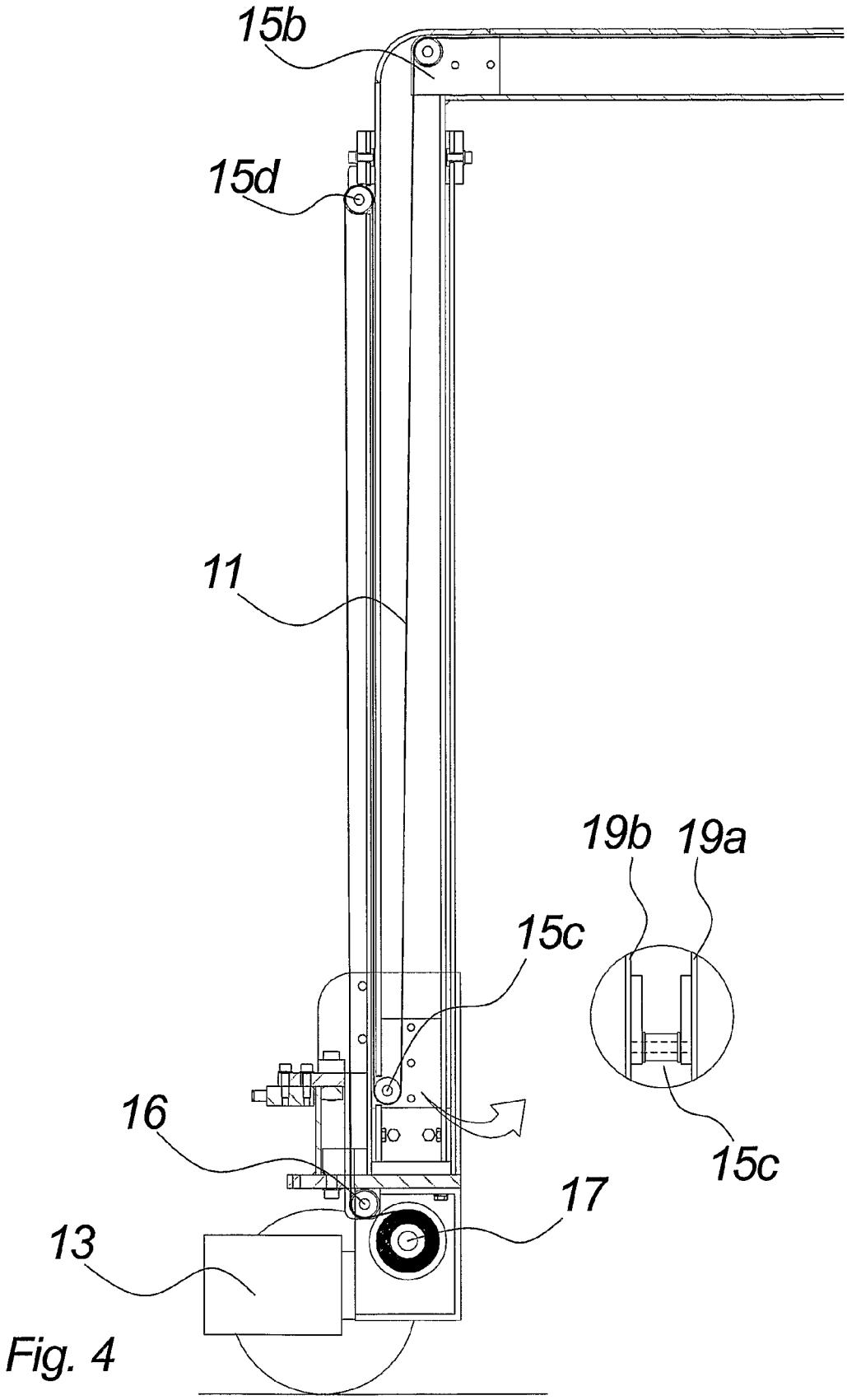
FIG. 4 illustrates a section of the handling system including the support connection path, a first locking system and the drive means.

FIG. 4 illustrates a section of the handling system 1 including the path of the support connection 11, a first locking system 10 and the drive means 16, 17.

The figure further illustrates a section of the support connection path and in more details than the schematically FIG. 3. Especially the path change from the inner of the guided end of the vertical part 7 of the lifting arm 3 (at the bottom support connection guide 15*c*) and the path change from the above mentioned minor space into the space of the vertically fixed bottom part 2 (at the top support connection guide 15*d*).

The first locking system 10 locks the lifting arm 3 firmly to the bottom part 2 by forcing a wing bolt through a hole in the bottom part 2 and into one of the locking holes 9 (illustrated in FIG. 1) in the vertical part 7 of the lifting arm 3. The tip of the wing bolt or the locking holes are shaped in such a way that e.g. a 90 degree turn of the wing bolt will force the tip out of the locking hole and consequently allows the vertical part 7 to move freely.

The locking system 10 may be replaced by an electric actuated brake system in which a preferred embodiment will be explained in details with reference to FIG. 11.

Figure 11:
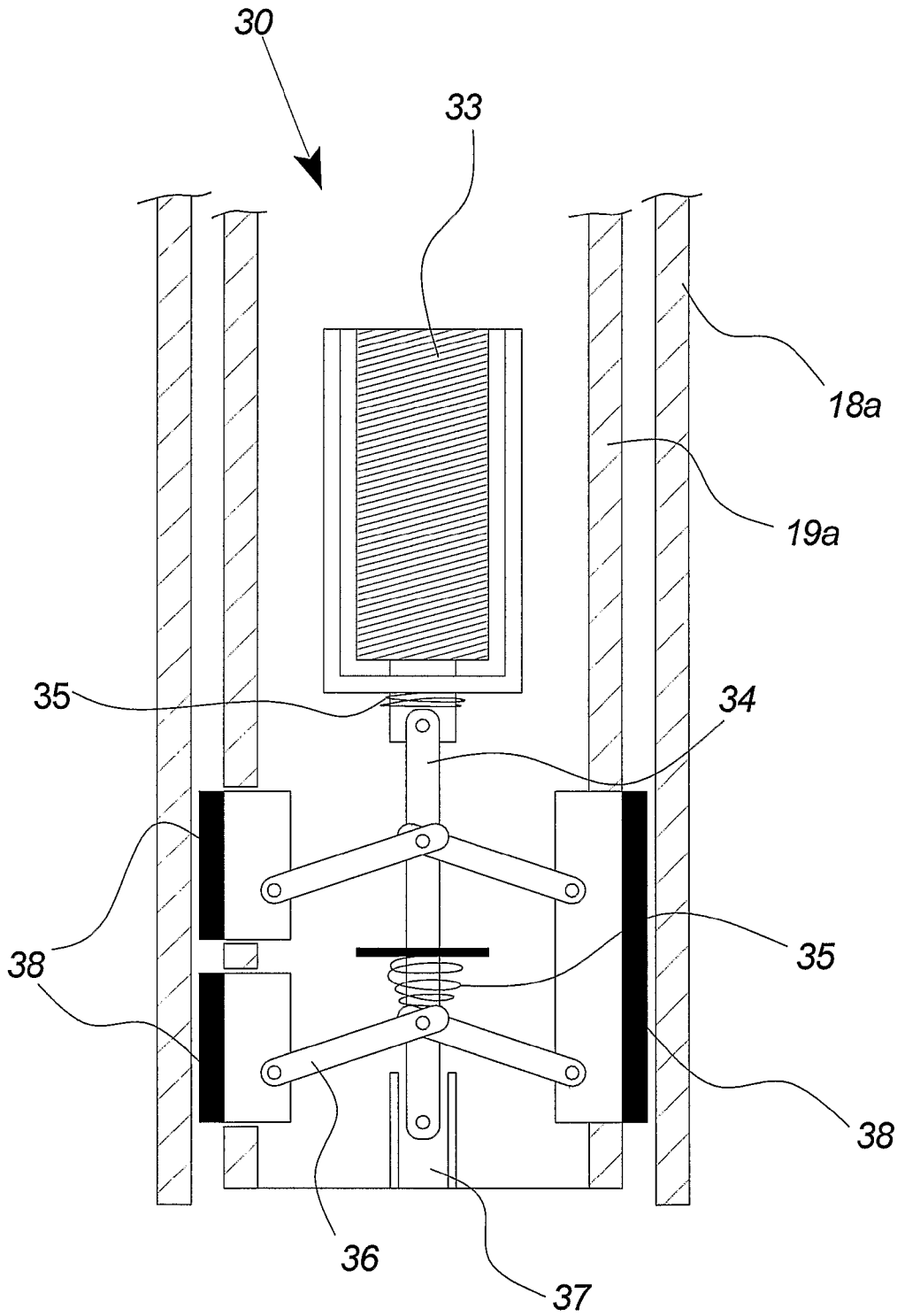
FIG. 11 illustrates a sectional cross view of the handling system and especially a brake system positioned within the lifting arm at the low end.

The locking system 10 may also be electrified in a similar manner as described in relation to FIG. 11 e.g. with the use of an electromagnet.

The minor magnified area illustrates the bottom support connection guide 15*c* as an idling pulley for guiding the support connection 11. All the support connection guides 15*a* to 15*d* and 16 may be idling pulleys as illustrated in the area.

Figure 5:
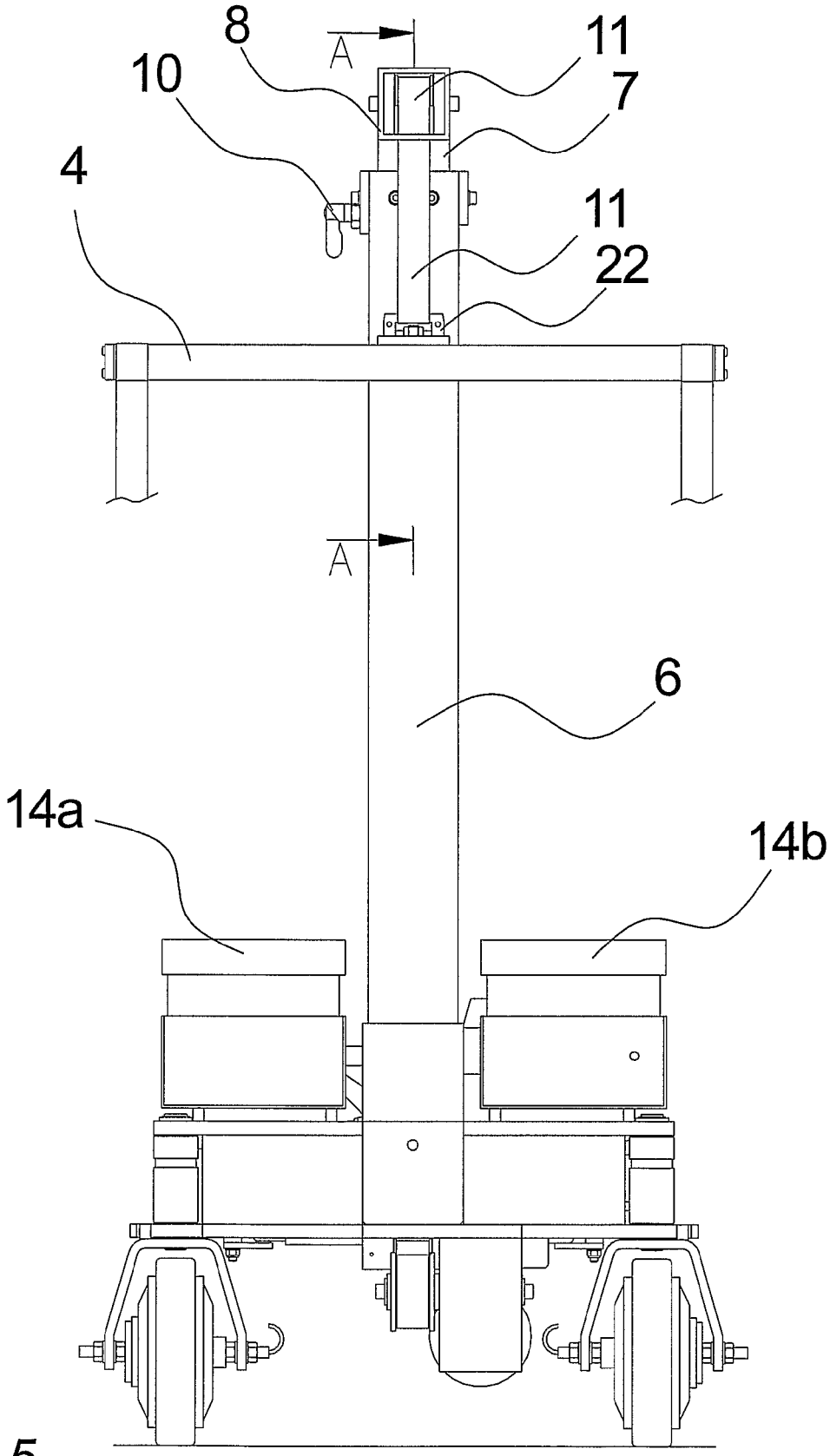
FIG. 5 illustrates the handling system seen from the front.

FIG. 5 illustrates the handling system 1 seen from the front.

The figure especially illustrates the free end of the lifting arm 3 wherein the support part 4 may be raised to a position just below the lifting arm. The support part 4 has a link to the support connection 11 in which the link includes two locking holes 22 for a second locking system (illustrated in FIG. 8). The support part 4 may be fixed to the lifting arm 3 in the two locking holes 22 by engaging with the means of the second locking system.

The locking means may in further embodiments fix the support part 4 to the lifting arm in other positions instead of the suggested position.

Figure 6:
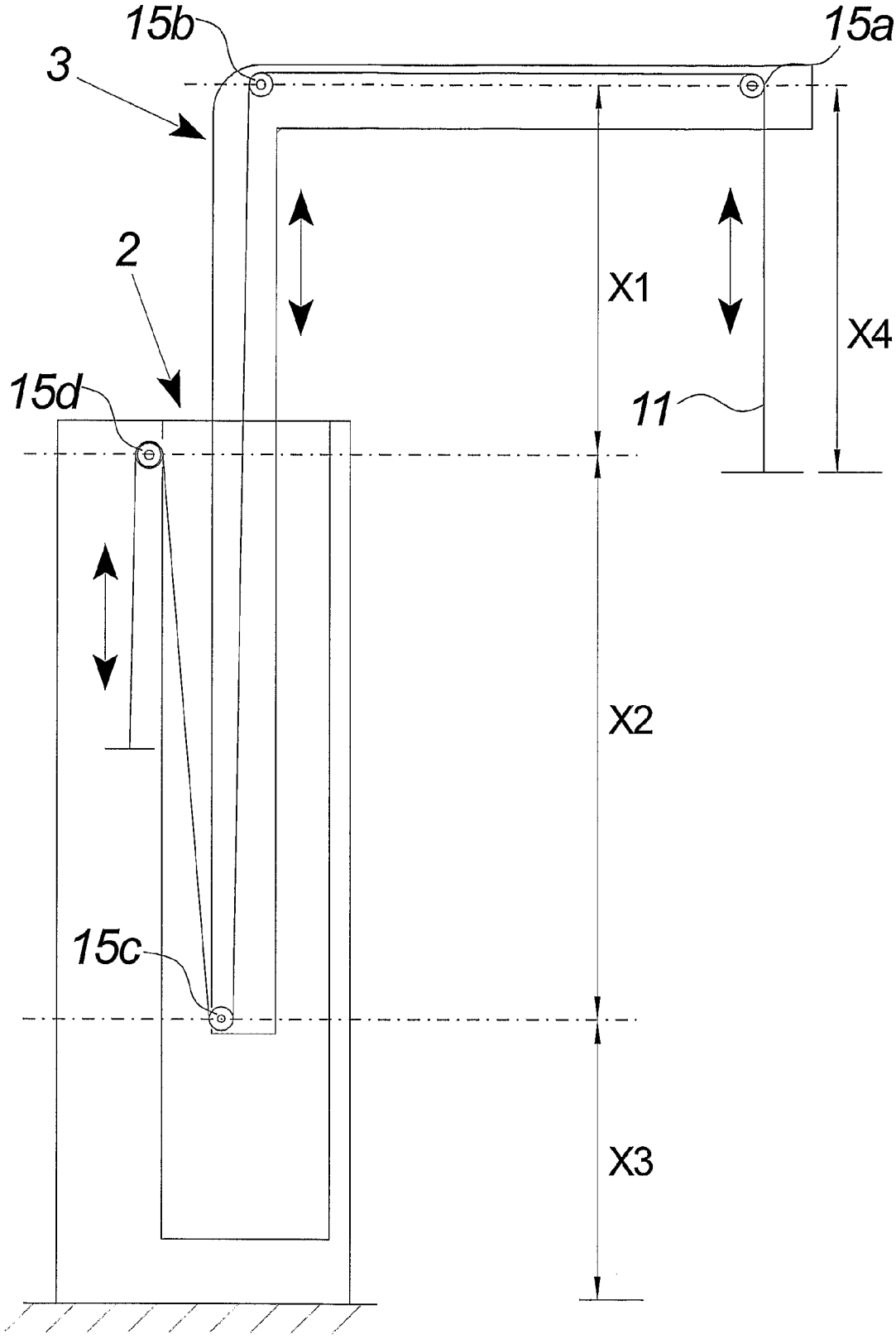
FIG. 6 illustrates schematically the vertically distances of the handling system which may change during use of the system.

FIG. 6 illustrates schematically the vertically distances of the handling system which may change during use of the system.

When the person is hanging in the support part 4 a winding or unwinding of the support connection 11 by the drive means will result in a change of the distances X1, X2, X3 between the support connection guides 15*a*/15*b*, 15*c* and 15*d*, respectively.

The distance X2 defines the longest possible distance which the lifting arm 3 may be raised an lowered as the bottom support connection guide 15*c* can only move to the same horizontal level as the fixed top support connection guide 15*d* (both however restricted by the length of the vertical part 7 of the lifting arm 3 or the guiding part 6 of the bottom part 2).

The figure further illustrates the distance X4 which is the distance from the lifting arm (the front support connection guide 15*a*) to the support part 4 such as a harness or chair with a person to be handled. The distance X4 may be changed by winding or unwinding the support connection 11 and either maintain or change the position of the lifting arm 3.

Figure 7:
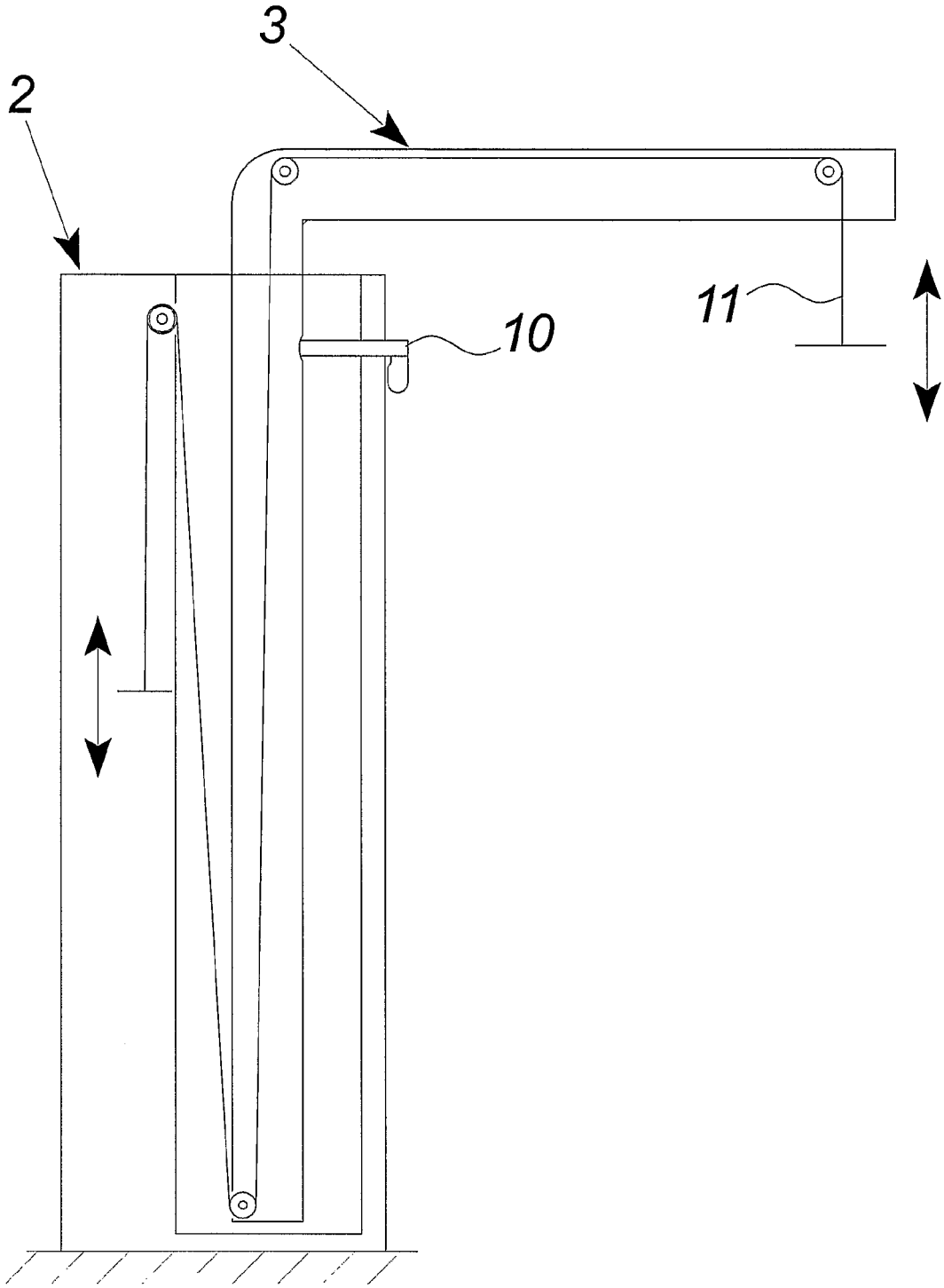
FIG. 7 illustrates schematically the movement of the support connection with a locking system engaging the bottom part and lifting arm of the handling system.

FIG. 7 illustrates schematically the movement of the support connection with the first locking system 10 engaging the bottom part 2 and lifting arm 3 of the handling system 1 allowing the support part 4 to move freely in response to the actions of the drive means 17.

Figure 8:
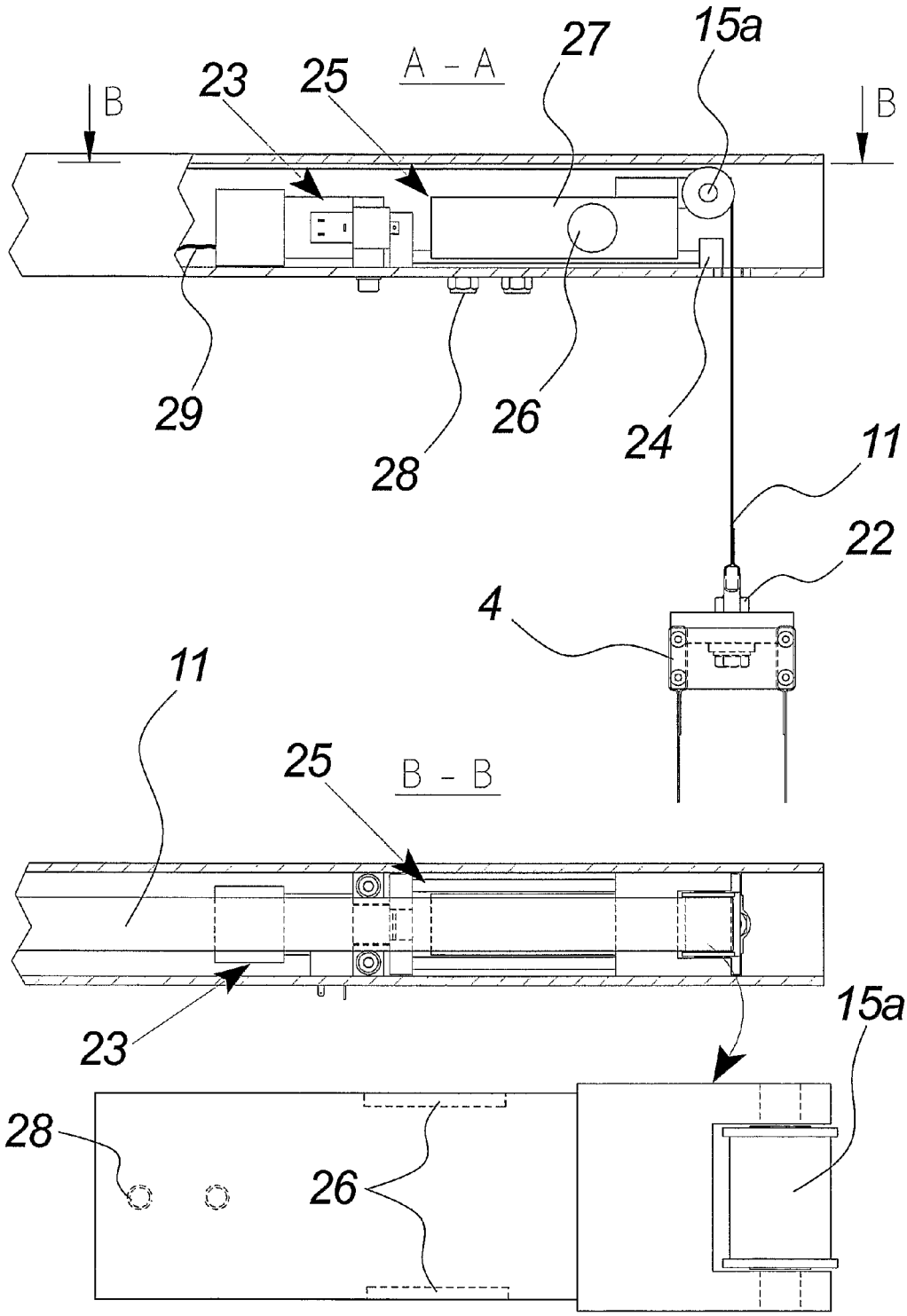
FIG. 8 illustrates a second locking system and a weighting system of the handling system according to the invention.

FIG. 8 illustrates an embodiment of the second locking system 23 and a weighting system 25 of the handling system according to the invention.

The second locking system 23 comprises a magnetic actuator controlling lock engaging means 24. The lock engaging means 24 is a stick with a fork shaped head in which the two branches extend. The locking holes 22 of the support part 4 are entered into the lifting arm when the support part 4 is raised to meet the lifting arm 3. Hereby the lock engaging means 24 may engage the locking holes 22 when the magnetic actuator is activated and consequently the support part 4 is fixed to the lifting arm 3.

In this locked or fixed position the lifting arm is ready to be lowered instead of the support part.

The weighting system 25 comprises at least one strain gauge or a similar weighting cell 26 wherein the weighting data from the weighting cell is transferred to a computer or data storage in the bottom part 2 with cables 29 through the inner of the lifting arm 3. The strain gauge 26 is positioned on the side or sides of a strain gauge block 27 which is mounted to lower wall of the lift arm by two bolts 28. The bolts are mounted in one end of the block 27 and the other end of the block is lifted a distance over the lower wall of the lift arm with the strain gauge 26 mounted in between the bolts and the free end. The free end of the block holds the front support connection guide 15*a* i.e. the weight strain of the person and the support connection 11 is directly transferred to the strain gauge 26.

The middle figure illustrates from above how the path of the support connection 11 extends over the weighting system 25 and the front support connection guide 15*a* before extending out of the lifting arm through an opening toward the support part 4.

The lower figure further illustrates the possible positions of one or more strain gauges 26 on the strain gauge block 27 and in relation to the front support connection guide 15*a*.

Figure 9:
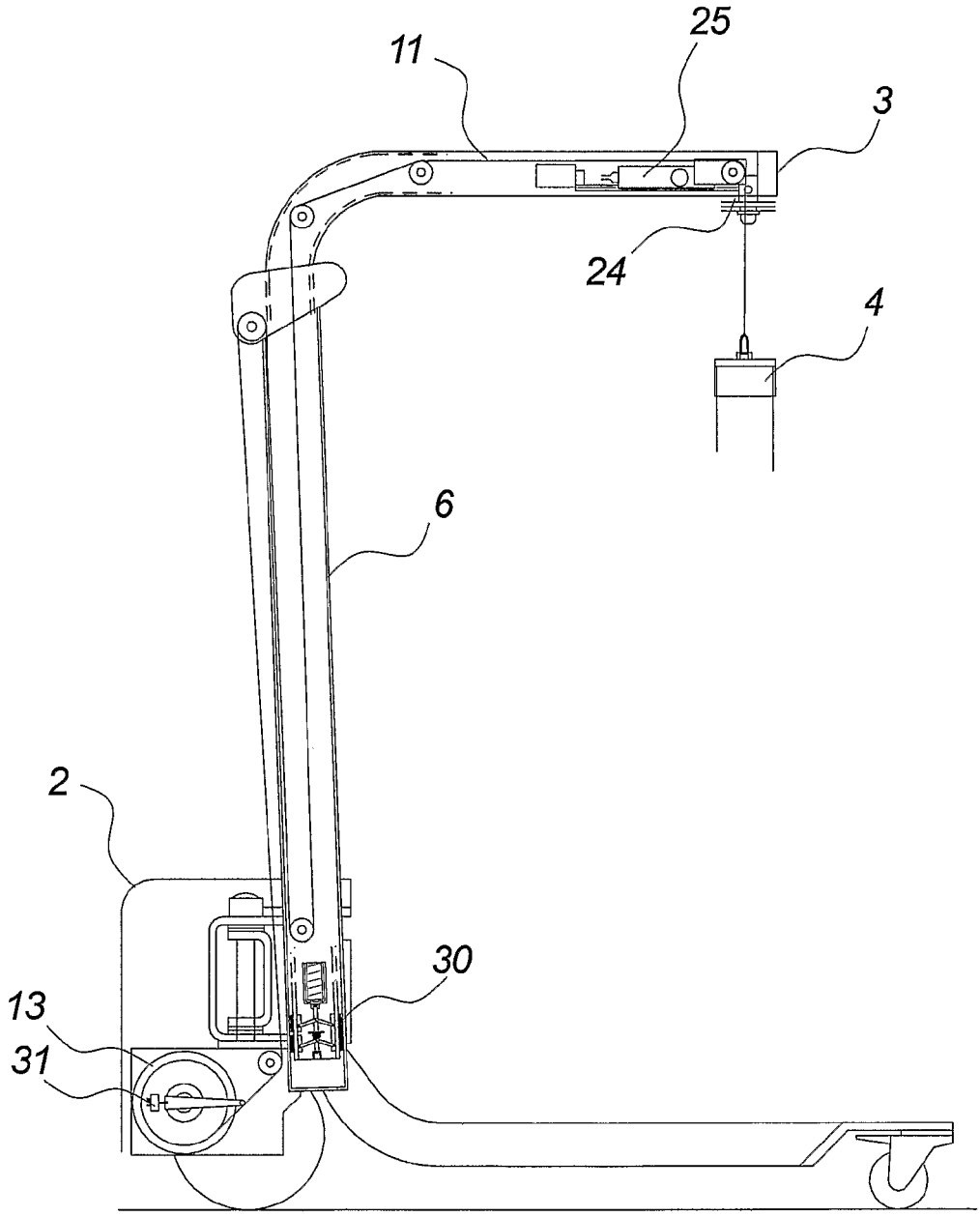
FIG. 9 illustrates the handling system in another preferred embodiment of the invention.

FIG. 9 illustrates the handling system in another preferred embodiment of the invention.

The embodiment especially differs from the previous embodiment of the handling system (especially illustrated in FIG. 4) by positioning the electric motor and winch of the drive system behind controlled drive wheels in bottom part 2. Further, an electric brake system 30 has replaced the locking means 10. However the locking system may be used in this embodiment instead of the electric brake system 30 and the electric brake system 30 may be used with the previous embodiment.

Further, the present embodiment is illustrated with the weighting system 25 build into the lifting arm 3 but the embodiment may also be established without a weight system.

Figure 10A:
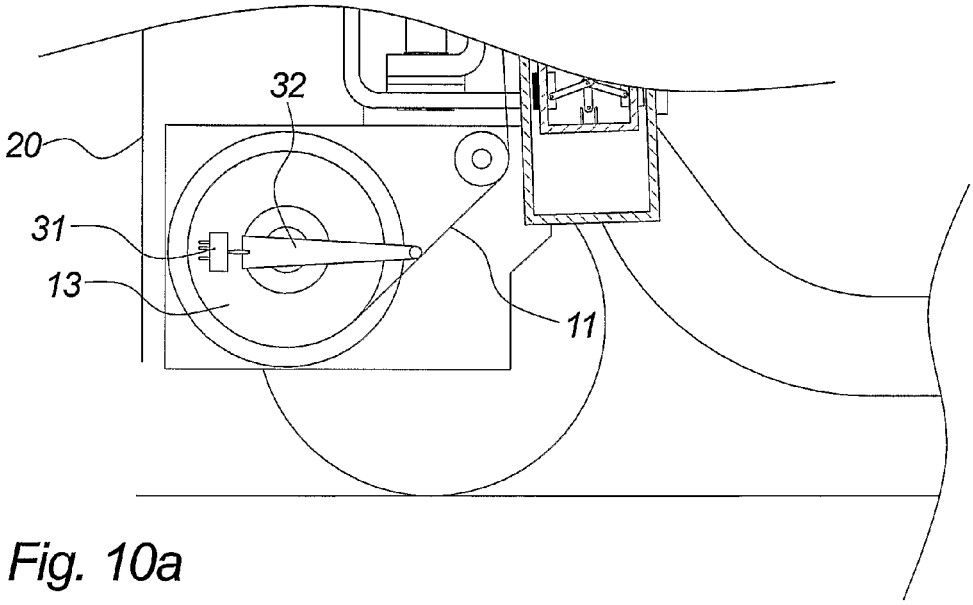
FIGS. 10*a* and 10*b* illustrate a drive system used in the handling system according to the invention.
Figure 10B:
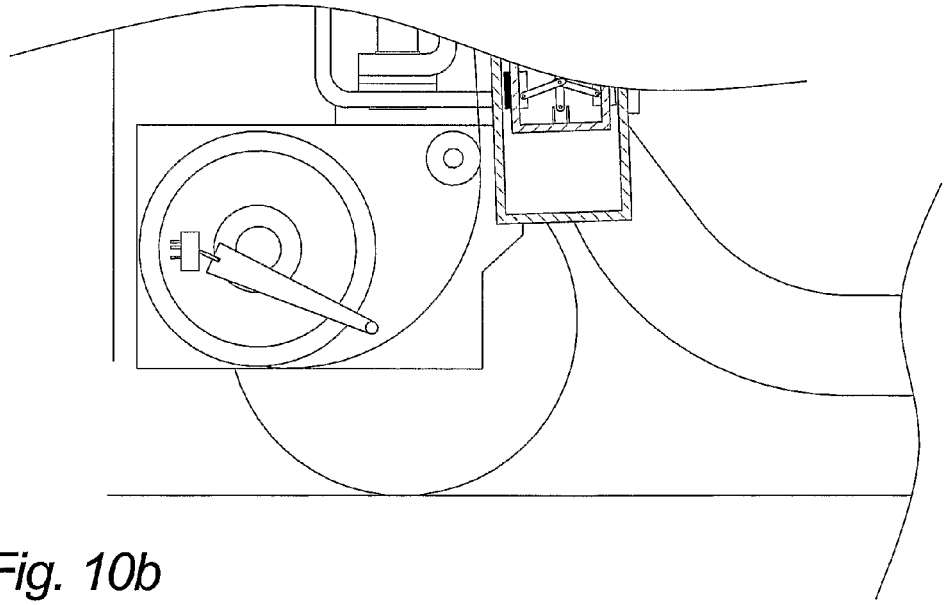

FIGS. 10*a* and 10*b* illustrate drive means used in an embodiment of the handling system according to the invention.

FIG. 10*a* illustrates a normal situation in using the handling system and especially the drive means 30 and the support connection 11 such as a belt.

The situation of the figure may be the lifting of a person whereby the support connection 11 is tight and the drive means and the brake system are active i.e. winding in and locked, respectively. Similarly, the drive means may be unwinding if the person is being lowered while the brake system is still active. The support connection 11 would during normal operation also be tight if the brake system 10, 30, which fixates the vertical position of the lifting arm 3 in relation to the bottom part 2, was disengaged. In this operation mode the drive means 13—when activated—adjust the vertical position of the lifting arm 3 upwards or downwards whereas the support parts 4 vertical position would be constant in relation to the lifting arm 3. An exception of this could be if the lifting arm 3 was provided with an actuator—extending and retracting between the lifting arm 3 and the bottom part 2. Then the lifting arm 3 would be able to be lowered or raised while the support part maintains a constant vertical position in relation to the bottom part 2 or the ground. During normal operation the second locking system 23 would always be engaged during this vertical adjustment, but the vertical adjustment would under most circumstances be able to occur no matter if the second locking system 23 is engaged or not.

An exception could e.g. be if the drive means 13 where unwinding and the lifting arm 3 reaches its lowest position, then the support part 4 would start to lower in relation to the lifting arm 3. But in a preferred embodiment the lifting arm 3 or the bottom part 2 would be provided with end switches, which would stop the movement of the lifting arm 3 in relation to bottom part 2 if an end position of the lifting arms guided movement was reached.

The tension of the support connection 11 is detected by a control unit 31 with an actuator arm 32. In the illustrated embodiment of the invention one end of the arm rests on the top side of the support connection 11 and the other end is connected to a switch arm in the control unit 31, but in another embodiment one end of the arm could also be pressed up against the bottom side of the support connection 11 e.g. by means of one or more springs (not shown). The switch and the control unit is part of the control system which controls the handling system such as the power supply to the electric motor of the drive means.

FIG. 10*b* illustrates a not normal situation for the handling system.

The switch arm will be in one position if the support connection 11 is tight (as illustrated in FIG. 10*a*) and in another position (as illustrated in FIG. 10*b*) if the support connection 11 is loose for some reason. E.g. if—as earlier explained—the arm pressed against the bottom side of the support connection 11 and the support connection 11 had totally unwinded and now is winding the support connection 11 onto the drum of the winch in the wrong direction, the arm would also raise and hereby detect this failure. The support connection 11 could e.g. also become loose if the second locking system 23 was engaged—fixating the vertical position of the support part 4 in relation to the lifting arm 3—and the drive means 13 where unwinding and continued unwinding even though the lifting arm 3 had reached its lowest position.

Further the electric motor of the drive means could also comprises a safety functionality which reacts in response to an overspeed of the winch. The overspeed may occur if the motor gear should break and the safety functionality will immediately block the unwinding of the support connection 11.

FIG. 11 illustrates a sectional cross view of the handling system 1 and especially a brake system 30 positioned and fixated within the lifting arm 3 at the low end.

The brake system 30 comprises electric actuator means 33 such as an electro magnet and spring means 35 controlling the position of a main rod 34. The main rod 34 is connected in one end to the electric actuator means 33 where the other end extends freely.

A number of side rods 36 are in one end pivotally connected to the side of the main rod 34. At the other end of each side rod is connected a brake block 38. The lower end of the guided end of the lifting arm is provided with a number of openings in the sidewall 19.

The openings allow the brake blocks 38 simultaneously to be forced against the inner sidewall 18 of the guiding part of the bottom part.

The blocks are illustrated as two small blocks to one side and one large block to the other side. Usually, either two small blocks or one large block on each side will be used.

In one situation: The blocks are forced against the sidewall by the spring means 35 actuating the main rod 34 in one direction while the electric actuator means are not activated. The side rods will self lock in a substantially perpendicular angle to the main rod. Hereby is achieved that the lifting arm 3 is locked to the guiding part of the bottom part 2.

The bottom end of the main rod 34 facing downwards is in this embodiment guided in brake guiding and control means 37.

In another situation: The blocks are released as the electric actuator means are activated and actuating the main rod 34 in the opposite direction by overpowering the force of the spring means 35. Hereby is achieved that the lifting arm 3 is unlocked from the guiding part of the bottom part 2 and may move as a part of the handling system 1.

In this embodiment of the invention, the means 37 are part of an electric circuit where the bottom end of the main rod establishes an electric contact e.g. indirectly by activating a switch or directly by conducting an electric current from one side of the means to another.

Consequently, the brake guiding and control means 37 are also used as indication of the brake situation i.e. the locked/unlocked status of the handling system. The indication signal is used as an input to a control system for overall controlling the handling system.

In another embodiment the brake system 30 may be positioned in an upper section of the guiding part 6 of the bottom part 2 e.g. replacing and occupying the position of the first locking system 10 (as illustrated in FIG. 5). In this embodiment the brake blocks may be forced against the surface of the lifting arm through holes in the guiding part 6 but otherwise function as described above.

The control system may receive and combine a number of different input signals such as the above mentioned indication signal from the brake system, the control unit 31/actuator arm 32 and the weighting system.

The weighting system may supply input signals indicating a number of situations such as an overweight situation by a signal indicating a weight above a max. load such as 200-250 kilograms, which at least triggers an alarm;

a normal situation by a signal indicating a weight between a min. load such as below 1 kilograms and the max. load, or a potential fault situation by a signal indicating a weight below the min. load e.g. weight below a limit of 1 kilogram (excluding the weight of the lifting arm), when moving the lifting arm 3.

The weight signals may for example be combined with the signals from the control unit in order to analyse the situation. The combined signals may indicate that the support connection 11 is loose or alternatively is winding up in the wrong direction on the winch drum.

Further signals may be received from the power detector of the batteries or the like as well as status signals from the second locking system.

The result from the control system is especially used in controlling on/off and rotation direction of the electric motor in the drive means butt.

It will also be understood that the invention is not limited to the particular examples described above but may be designed in a multitude of varieties within the scope of the invention, as specified in the claims. Especially, the support connection guides and the weighting system may be positioned in other places than the suggested. The weighting system may for example be positioned between two guides with no connection to the guides but in a position and in such a way that the support connection 11 is directly forced against the weighting system.

The invention claimed is:

1. Handling system for lifting or moving a person from a first position to another said system comprising a bottom part being vertically fixed, a lifting arm being guided by said bottom part allowing said lifting arm to at least be vertically adjustable, a support part for fixating and supporting said person during the lifting and moving, and a support connection for said support part, wherein said support connection is connected to drive means, for winding and unwinding said support connection, via the lifting arm, wherein said drive means includes a winch and an electrical motor configured so that said support connection is arranged to be winded and unwinded on a drum of said winch, wherein said drive means is part of and fixed to said bottom part, and wherein said drive means facilitates winding and unwinding said support connection from said bottom part.

2. A handling system according to claim 1, wherein said lifting arm comprises, a vertical part including a guided end inside the bottom part and a horizontal part including a free lifting end.

3. A handling system according to claim 2, wherein said lifting arm comprises a bottom support connection guide placed at or near a bottom of said vertical part of said lifting arm and said bottom part comprises a top support connection guide placed at or near a top of said guiding part of the bottom part.

4. A handling system according to claim 2, wherein said lifting arm comprises a front support connection guide placed at said free lifting end and a corner support connection guide placed at the corner of the lifting arm.

5. A handling system according to claim 4, wherein said support connection guides are idling pulleys guiding said support connection.

6. A handling system according to claim 1, wherein said support connection constitutes a load transferring connection between said lifting arm and said bottom part.

7. A handling system according to claim 6, wherein said support connection constitutes a load transferring connection by running substantially directly between said bottom support connection guide and said top support connection guide.

8. A handling system according to claim 1, wherein said support connection is a continuous belt.

9. A handling system according to claim 1, wherein said drive means for winding and unwinding said support connection, is driven by an electrical motor with gearing means.

10. A handling system according to claim 1, wherein said handling system comprise at least one first locking system for locking a vertical position of said lifting arm in relation to said bottom part.

11. A handling system according to claim 10, wherein said bottom part comprises at least one locking system with at least one lock engaging means and locking holes for securing said lifting arm to said bottom part.

12. A handling system according to claim 11, wherein said at least one lock engaging means are an electromagnetically solenoid lock.

13. A handling system according to claim 10, wherein said at least one first locking system is a friction lock.

14. A handling system according to claim 13, wherein said friction lock is disengaged by means of electric actuator means.

15. A handling system according to claim 10, wherein said at least one first locking system is positioned on said lifting arm.

16. A handling system according to claim 10, wherein said at least one first locking system comprises brake guiding and control means for indicating a status of said at least one first locking system .

17. A handling system according to claim 10, wherein said handling system comprises a second locking system with at least one lock engaging means and locking holes for securing said support part to said lifting arm at a fixed height.

18. A handling system according to claim 17, wherein said lock engaging means of said second locking system is engaged and/or disengaged by means of one or more electric actuators.

19. A handling system according to claim 1, wherein said handling system comprises a control unit for determining if said support connection is tight or not.

20. A handling system according to claim 19, wherein said control unit comprises an arm engaged with said support connection at or in close proximity of said drive means.

21. A handling system according to claim 1, wherein said handling system comprises a weighting system for determining a weight of said person when said person is positioned in said support part.

22. A handling system according to claim 21, wherein said weighting system determines the weight of said person by use of weighting means measuring a tension of said support connection carrying the weight of the person in said support part.

23. A handling system according to claim 22, wherein said weighting means include at least one strain gauge being part of the front and/or corner support connection guides.

24. A method for lifting or moving a person from a first position to another by means of a handling system according to claim 1, said method comprising:

positioning the person in the support part with the support connection, activating the drive means including the winch and the electric motor, for winding and unwinding the support connection, via the lifting arm of said handling system, said drive means being part of the vertically fixed bottom part of said handling system, and guiding the lifting arm in relation to said bottom part allowing the lifting arm or the support part to be vertically adjustable.

* * * * *